US007873515B2

(12) United States Patent
Padhi et al.

(10) Patent No.: US 7,873,515 B2
(45) Date of Patent: Jan. 18, 2011

(54) SYSTEM AND METHOD FOR ERROR RECONSTRUCTION OF STREAMING AUDIO INFORMATION

(75) Inventors: Kabi P. Padhi, Singapore (SG); Sudhir K. Kumar, Singapore (SG); Sapna George, Singapore (SG)

(73) Assignee: STMicroelectronics Asia Pacific Pte. Ltd., Singapore (SG)

( * ) Notice: Subject to any disclaimer, the term of this patent is extended or adjusted under 35 U.S.C. 154(b) by 1069 days.

(21) Appl. No.: 10/995,835

(22) Filed: Nov. 23, 2004

(65) Prior Publication Data

US 2006/0111899 A1 May 25, 2006

(51) Int. Cl.
*G10L 21/02* (2006.01)
*G10L 19/00* (2006.01)

(52) U.S. Cl. ..... 704/228; 704/219; 704/220

(58) Field of Classification Search ..... 704/219, 704/220, 228

See application file for complete search history.

(56) References Cited

U.S. PATENT DOCUMENTS 4,757,540 A * 7/1988 Davis ..... 704/278
5,274,711 A * 12/1993 Rutledge et al. ..... 704/225
5,381,143 A * 1/1995 Shimoyoshi et al. ..... 341/51
6,233,550 B1 * 5/2001 Gersho et al. ..... 704/208
6,636,829 B1 * 10/2003 Benyassine et al. ..... 704/201
6,757,654 B1 * 6/2004 Westerlund et al. ..... 704/262
6,885,992 B2 * 4/2005 Mesarovic et al. ..... 704/500
7,050,980 B2 * 5/2006 Wang et al. ..... 704/503
7,146,309 B1 * 12/2006 Benyassine et al. ..... 704/201
2003/0215013 A1 * 11/2003 Budnikov ..... 375/240.16

OTHER PUBLICATIONS

David J. Goodman et al., "Waveform Substitution Techniques for Recovering Missing Speech Segments in Packet Voice Communications", IEEE Transactions on Acoustics, Speech, and Signal Processing, vol. ASSP-34, No. 6, Dec. 1986, pp. 1440-1448.

International Telecommunication Union, "A High Quality Low-Complexity Algorithm for Packet Loss Concealment with G.711", 1999, 26 pages.

* cited by examiner

*Primary Examiner*—Eric Yen
(74) *Attorney, Agent, or Firm*—Lisa K. Jorgenson; William A. Munck

(57) ABSTRACT

A method includes receiving a sequence of frames containing audio information and determining that a frame is missing in the sequence of frames. The method also includes comparing the frame that precedes the missing frame to the received frames to identify a selected frame. The method further includes identifying a replacement frame comprising the frame that follows the selected frame. In addition, the method includes inserting the replacement frame into the sequence of frames in place of the missing frame.

30 Claims, 7 Drawing Sheets

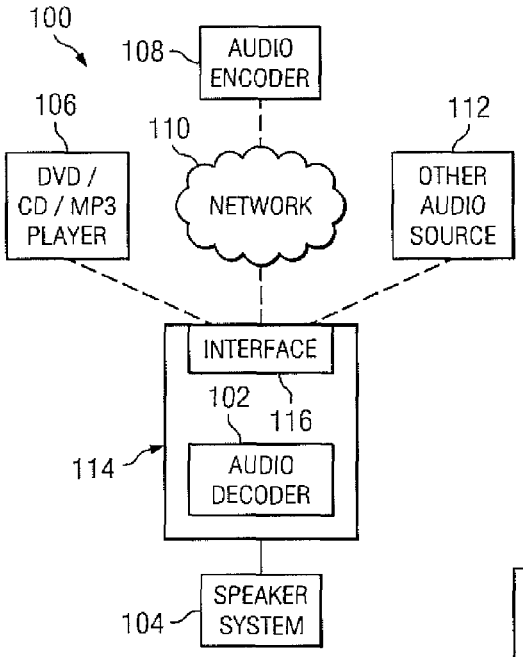
FIG. 1
FIG. 2
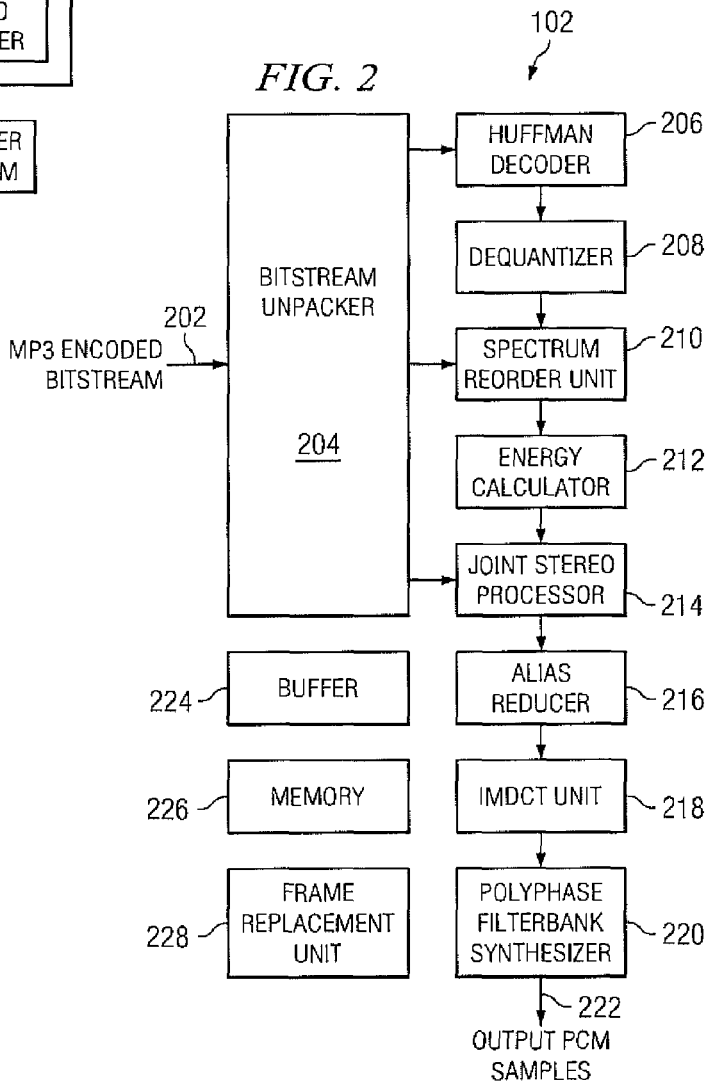

SYSTEM AND METHOD FOR ERROR RECONSTRUCTION OF STREAMING AUDIO INFORMATION

TECHNICAL FIELD

This disclosure is generally directed to audio systems and more specifically to a system and method for error reconstruction of streaming audio information.

BACKGROUND

The popularity of digital audio applications continues to rise in the United States and around the world. For example, many consumer devices are now available for facilitating playback of digital audio files, such as Moving Picture Experts Group Layer III ("MP3") files. Also, many consumer devices have been developed to handle streaming audio bitstreams, such as devices for providing access to Internet radio stations.

A problem with conventional digital audio applications is that disruptions in the reception of audio information can be noticed by the listeners. For example, frames containing audio information may be delayed or lost when being transmitted over a network. If the audio information is being received and played back in real-time, the missing audio information could cause silent periods or other glitches to occur in the playback. These silent periods or other glitches represent artifacts that may be easily noticeable to listeners, which may interfere with the listeners' enjoyment of the playback.

SUMMARY

This disclosure provides a system and method for error reconstruction of streaming audio information.

In a first embodiment, a method includes receiving a sequence of frames containing audio information and determining that a frame is missing in the sequence of frames. The method also includes comparing the frame that precedes the missing frame to the received frames to identify a selected frame. The method further includes identifying a replacement frame comprising the frame that follows the selected frame. In addition, the method includes inserting the replacement frame into the sequence of frames in place of the missing frame.

In a second embodiment, an audio decoder includes decoding logic capable of receiving and decoding audio information contained in a sequence of frames. The audio decoder also includes frame replacement logic capable of determining that a frame is missing in the sequence of frames. The frame replacement logic is also capable of comparing the frame that precedes the missing frame to the received frames to identify a selected frame. The frame replacement logic is further capable of identifying a replacement frame comprising the frame that follows the selected frame. In addition, the frame replacement logic is capable of inserting the replacement frame into the sequence of frames in place of the missing frame.

In a third embodiment, an audio decoder includes one or more processors collectively capable of receiving a sequence of frames containing encoded audio information and determining that a frame is missing in the sequence of frames. The one or more processors are also collectively capable of comparing the frame that precedes the missing frame to the received frames to identify a selected frame and identifying a replacement frame comprising the frame that follows the selected frame. The one or more processors are further collectively capable of inserting the replacement frame into the sequence of frames in place of the missing frame and decoding the audio information contained in the sequence of frames. The audio decoder also includes at least one memory capable of storing the frames containing the encoded audio information.

In a fourth embodiment, a computer program is embodied on a computer readable medium and is capable of being executed by a processor. The computer program includes computer readable program code for receiving a sequence of frames containing audio information and determining that a frame is missing in the sequence of frames. The computer program also includes computer readable program code for comparing the frame that precedes the missing frame to the received frames to identify a selected frame. The computer program further includes computer readable program code for identifying a replacement frame comprising the frame that follows the selected frame. In addition, the computer program includes computer readable program code for inserting the replacement frame into the sequence of frames in place of the missing frame.

In a fifth embodiment, an apparatus includes an interface capable of receiving a sequence of frames of encoded audio information. The apparatus also includes an audio decoder capable of determining that a frame is missing in the sequence of frames and comparing the frame that precedes the missing frame to the received frames to identify a selected frame. The audio decoder is also capable of identifying a replacement frame comprising the frame that follows the selected frame. The audio decoder is further capable of inserting the replacement frame into the sequence of frames in place of the missing frame. In addition, the audio decoder is capable of decoding the encoded audio information in the sequence of frames.

Other technical features may be readily apparent to one skilled in the art from the following figures, descriptions, and claims.

BRIEF DESCRIPTION OF THE DRAWINGS

For a more complete understanding of this disclosure and its features, reference is now made to the following description, taken in conjunction with the accompanying drawings, in which:

FIG. 1 illustrates an example audio processing system according to one embodiment of this disclosure;

FIG. 2 illustrates an example audio decoder according to one embodiment of this disclosure;

DETAILED DESCRIPTION

FIG. 1 illustrates an example audio processing system 100 according to one embodiment of this disclosure. The embodiment of the audio processing system 100 shown in FIG. 1 is for illustration only. Other embodiments of the audio processing system 100 may be used without departing from the scope of this disclosure.

Figure 3:
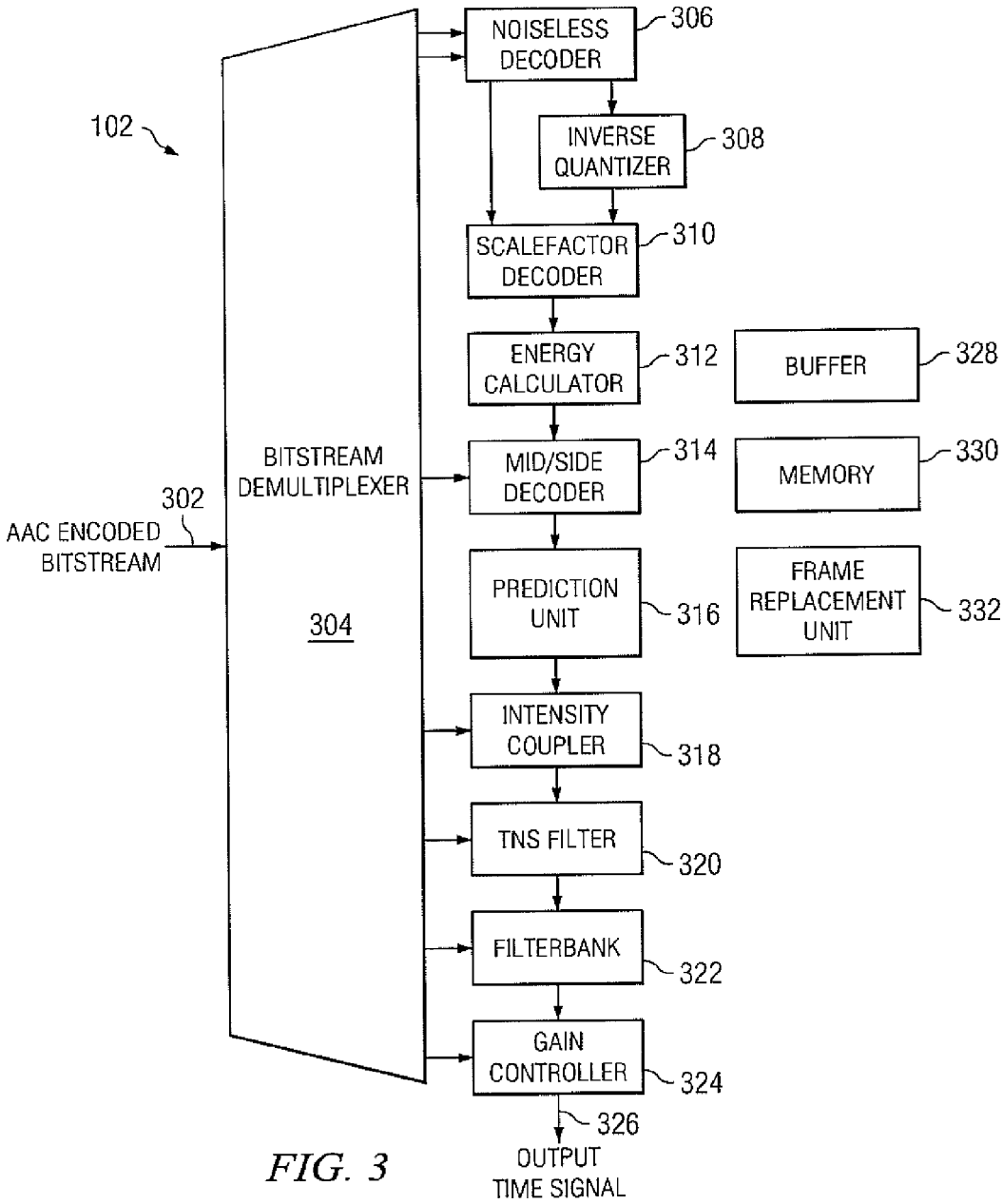
FIG. 3 illustrates another example audio decoder according to one embodiment of this disclosure.

As shown in FIG. 1, the audio processing system 100 includes an audio decoder 102. The audio decoder 102 receives and decodes encoded audio information. For example, the audio decoder 102 could receive and decode audio information that has been encoded using a Moving Picture Experts Group ("MPEG") Layer I, Layer II, or Layer III (also known as "MP3") audio encoding scheme. The audio decoder 102 could also receive and decode audio information that has been encoded using an MPEG Advanced Audio Coding ("AAC") or Non-Backward Compatible ("NBC") encoding scheme. The audio decoder 102 could decode audio information encoded using any other or additional encoding scheme. The audio decoder 102 includes any hardware, software, firmware, or combination thereof for decoding encoded audio information. As an example, the audio decoder 102 could include one or more processors and one or more memories capable of storing instructions and data used by the one or more processors. Example embodiments of the audio decoder 102 are shown in FIGS. 2 and 3, which are described below.

A speaker system 104 is coupled to the audio decoder 102. In this document, the term "couple" and its derivatives refer to any direct or indirect communication between two or more elements, whether or not those elements are in physical contact with one another. The speaker system 104 presents audio information that has been decoded by the audio decoder 102. For example, the speaker system 104 could play back the decoded audio information by generating audio sounds that are perceptible to one or more listeners. The speaker system 104 includes any hardware, software, firmware, or combination thereof for presenting decoded audio information. As an example, the speaker system 104 could include a single speaker or multiple speakers. As a particular example, the speaker system 104 could include speakers in a television or other display device, and the audio information presented on the speaker system 104 could represent audio information for a movie or other audio/video program.

The encoded audio information received by the audio decoder 102 could originate from one or multiple sources. In the illustrated example, the audio decoder 102 could receive encoded audio information from a digital video disk ("DVD")/compact disc ("CD")/MP3 player 106. The DVD/CD/MP3 player 106 provides encoded audio information to the audio decoder 102. The audio information from the DVD/CD/MP3 player 106 could be encoded using any suitable encoding standard, such as MP3 or AAC. The DVD/CD/MP3 player 106 could also provide other information, such as encoded video information, for decoding and presentation on a display device such as a television. The DVD/CD/MP3 player 106 represents any suitable device capable of providing encoded audio information from a DVD, CD, minidisk, or other optical digital media.

As another example, the audio decoder 102 could receive encoded audio information from an audio encoder 108 over a network 110. The audio encoder 108 could provide any encoded audio information to the audio decoder 102. For example, the audio encoder 108 could represent an audio server capable of encoding and streaming an audio bitstream to the audio decoder 102 over the network 110. The audio encoder 108 includes any hardware, software, firmware, or combination thereof for encoding audio information or providing encoded audio information. Also, the network 110 represents any suitable wireline network, wireless network, or combination of networks capable of transporting information between the audio encoder 108 and the audio decoder 102. As a particular example, the audio encoder 108 could represent a device that encodes audio information for transmission over a satellite, cable, or other television network 110 or over a radio or other audio network 110. As another example, the audio encoder 108 could represent a computing device that provides encoded audio information over a home wireless network 110.

As yet another example, the audio decoder 102 could receive encoded audio information from any other audio source 112. The other audio sources 112 could represent any other suitable source(s) of audio information. For example, the other audio sources 112 could represent digital cameras, digital camcorders, satellite television receivers, cable television receivers, broadcast or other television receivers, surround sound or stereo receivers, or any other or additional audio sources.

As shown in FIG. 1, the audio decoder 102 could form part of an apparatus 114 that includes an interface (I/F) 116. The interface 116 represents an interface that allows the audio decoder 102 to receive audio information from one or more of the audio sources. For example, the interface 116 could represent a connector that allows the audio decoder 102 to be coupled to the DVD/CD/MP3 player 106 or other audio source 112 using an audio cable or other cable. The interface 116 could also represent a tuner or other wireless interface that receives radio, television, or other wireless signals. As particular examples, the audio decoder 102 could reside within an apparatus 114 such as an audio surround sound system, a stereo receiver, a cable set-top box, a satellite receiver, or other device. In other embodiments, the audio decoder 102 resides within the DVD/CD/MP3 player 106, other audio source 112, or other apparatus or system.

In one aspect of operation, the audio decoder 102 receives and decodes audio information. However, the audio decoder 102 may fail to receive part of the audio information to be decoded. For example, the audio decoder 102 may receive audio information in frames. In this document, the term "frame" refers to any unit of audio information received by the audio decoder 102. The audio decoder 102 may fail to receive some of the frames, or the audio decoder 102 may receive the frames late. As a particular example, the audio decoder 102 may fail to receive frames containing audio information transmitted over a wireless or other network. The missing audio information may create noticeable silent gaps or other glitches, referred to as "artifacts," when the audio information is played back for a listener.

To help correct for missing frames of audio information, the audio decoder 102 implements an error reconstruction technique that allows the audio decoder 102 to fill gaps in received audio information. The error reconstruction technique uses frequency-domain energy-based pattern recognition to identify audio information that could be used to fill a gap in the received audio information. The error reconstruction technique also uses time-domain splicing techniques to insert audio information into a gap in the received audio information.

This error reconstruction technique may allow the audio decoder 102 to perform error reconstruction in a computationally efficient manner. Also, when a particular frame of audio information is lost or delayed, conventional error reconstruction techniques typically either introduce silence or repeat the prior frame. This often introduces noticeable artifacts into the playback. The audio decoder 102 may use the characteristics of the received frames to more effectively handle lost frames, which may allow the audio decoder 102 to introduce fewer or no noticeable artifacts into the playback. In addition, the error reconstruction technique used by the audio decoder 102 may operate independent of the audio encoders that produce the encoded audio information, which may help to reduce the complexity of the audio encoders.

Although FIG. 1 illustrates one example of an audio processing system 100, various changes may be made to FIG. 1. For example, FIG. 1 illustrates one example environment in which the audio decoder 102 may operate. The audio decoder 102 could be used in any other environments or systems. Also, the functional division of FIG. 1 is for illustration only. Various components in FIG. 1 may be combined or omitted and additional components could be added according to particular needs. In addition, the audio decoder 102 could be used as a stand-alone device or as part of another device, such as the DVD/CD/MP3 player 106, another audio source 112, or a computing device such as a desktop or laptop computer.

FIG. 2 illustrates an example audio decoder 102 according to one embodiment of this disclosure. The embodiment of the audio decoder 102 is for illustration only. Other embodiments of the audio decoder 102 may be used without departing from the scope of this disclosure. Also, for ease of explanation, the audio decoder 102 may be described as operating in the system 100 of FIG. 1. The audio decoder 102 could be used in any other system.

In this example, the audio decoder 102 receives an audio bitstream 202. The audio bitstream 202 contains audio information that has been encoded, such as MP3-encoded audio information. The audio information could be formatted in any suitable manner. For example, the audio information could have DVD or other high quality, such as when the audio information represents an audio signal sampled at 48,000 samples per second. As another example, the audio information may be divided into frames containing 1,152 frequency-domain samples. The audio bitstream 202 could be received by the audio decoder 102 from a DVD/CD/MP3 player 106, audio encoder 108, or other audio source 112.

The audio bitstream 202 is provided to a bitstream unpacker 204. The bitstream unpacker 204 removes or "unpacks" the audio information from the bitstream 202 and provides the audio information to other components in the audio decoder 102. For example, the bitstream unpacker 204 could place the frames in proper order and provide the frequency-domain audio samples from the ordered frames to other components in the audio decoder 102. The bitstream unpacker 204 includes any hardware, software, firmware, or combination thereof for receiving an audio bitstream and removing audio information from the bitstream.

The unpacked audio information is provided by the bitstream unpacker 204 to a Huffman decoder 206. The Huffman decoder 206 decodes the frequency-domain audio samples contained in the received frames. The Huffman decoder 206 reverses Huffman encoding performed on the audio information before the audio information is received by the audio decoder 102. The Huffman decoder 206 includes any hardware, software, firmware, or combination thereof for decoding audio information. Although FIG. 2 illustrates the use of a Huffman decoder 206, other types of decoders could be used in the audio decoder 102.

A dequantizer 208 receives the Huffman-decoded audio samples from the Huffman decoder 206. The dequantizer 208 then converts the Huffman-decoded audio samples into frequency-domain spectral values. The dequantizer 208 could use any suitable technique to convert decoded audio samples into spectral values. The dequantizer 208 includes any hardware, software, firmware, or combination thereof for converting audio samples into spectral values.

A spectrum reorder unit 210 reorders the spectral values produced by the dequantizer 208. In some embodiments, a Huffman encoder that encodes the audio information may have reordered the audio samples during encoding, which allows the Huffman encoder to more effectively encode the audio information. The spectrum reorder unit 210 reorders the spectral values if necessary to place the spectral values in proper order. The spectrum reorder unit 210 includes any hardware, software, firmware, or combination thereof for reordering spectral values.

The spectral values are provided to an energy calculator 212. The energy calculator 212 identifies the frequency-domain energy of a frame of audio information. For example, the energy calculator 212 may use the spectral values corresponding to a frame of audio information to identify an average energy of the frame. The energy calculator 212 includes any hardware, software, firmware, or combination thereof for identifying the energy of a frame of audio information.

A joint stereo processor 214 receives the spectral values corresponding to the audio samples in the bitstream 202. The joint stereo processor 214 processes the spectral values to provide stereo effects in the output of the audio decoder 102. For example, the joint stereo processor 214 may separate the audio information into multiple (such as "left" and "right") channels up to a particular frequency. Audio information at higher frequencies is not separated into multiple channels, which may occur when the higher frequencies are less perceptible to listeners. The joint stereo processor 214 includes any hardware, software, firmware, or combination thereof for separating audio information into multiple channels.

An alias reducer 216 receives the multi-channel output of the joint stereo processor 214. The alias reducer 216 processes the multi-channel output so as to reduce or cancel aliasing effects that will be produced during later processing of the audio information. The alias reducer 216 may use any suitable technique to at least partially reduce aliasing effects. The alias reducer 216 includes any hardware, software, firmware, or combination thereof for reducing or eliminating aliasing effects.

An Inverse Modified Discrete Cosine Transform ("IMDCT") unit 218 transforms the output of the alias reducer 216 into polyphase filter subband samples. The IMDCT unit 218 reverses a Fourier-related transform used by an audio encoder to encode the audio information received in the bitstream 202. For example, the IMDCT unit 218 may receive and convert DCT coefficients into polyphase filter subband samples. The IMDCT unit 218 may use any suitable technique to convert the DCT coefficients into polyphase filter subband samples. The IMDCT unit 218 includes any hardware, software, firmware, or combination thereof for transforming audio data into polyphase filter subband samples.

A polyphase filterbank synthesizer 220 receives the subband samples produced by the IMDCT unit 218. The polyphase filterbank synthesizer 220 transforms the subband samples into Pulse Code Modulation ("PCM") samples in an output signal 222. For example, the polyphase filterbank synthesizer 220 could receive 32 subband blocks each containing 18 time-domain samples and convert them into 18 blocks each containing 32 PCM samples. In particular embodiments, the polyphase filterbank synthesizer 220 operates on 32 samples at a time, one from each subband block. The polyphase filterbank synthesizer 220 includes any hardware, software, firmware, or combination thereof for transforming subband samples into PCM samples.

As shown in FIG. 2, the audio decoder 102 also includes a buffer 224, a memory 226, and a frame replacement unit 228. The buffer 224 stores frame energies determined by the energy calculator 212. The buffer 224 could also temporarily store decoded audio information before the decoded audio information is provided to the speaker system 104 or other device or system for presentation. The memory 226 stores encoded frames of audio information that have been previously received by the audio decoder 102. The frame replacement unit 228 uses the frame energies stored in the buffer 224 and the frames stored in the memory 226 to fill in gaps caused by delayed or lost frames of audio information. The frame replacement unit 228 also inserts replacement frames into the gaps caused by delayed or lost frames, such as by splicing a replacement frame with frames preceding and following the replacement frame. Additional details and operations by the frame replacement unit 228 are described below. The buffer 224 and the memory 226 each represents any suitable memory or memories in any suitable arrangement. As an example, the memory 226 could represent a solid state memory, such as a multimedia memory card ("MMC") or a compact flash ("CF") card. The frame replacement unit 228 includes any hardware, software, firmware, or combination thereof for selecting and inserting replacement frames into received frames of audio information.

Although FIG. 2 illustrates one example of an audio decoder 102, various changes may be made to FIG. 2. For example, the functional division of the audio decoder 102 shown in FIG. 2 is for illustration only. Various components in FIG. 2 may be combined or omitted and additional components could be added according to particular needs.

FIG. 3 illustrates another example audio decoder 102 according to one embodiment of this disclosure. The embodiment of the audio decoder 102 is for illustration only. Other embodiments of the audio decoder 102 may be used without departing from the scope of this disclosure. Also, for ease of explanation, the audio decoder 102 may be described as operating in the system 100 of FIG. 1. The audio decoder 102 could be used in any other system.

In this example, the audio decoder 102 receives an audio bitstream 302. The audio bitstream 302 contains audio information that has been encoded, such as AAC-encoded audio information. The audio information may also be contained in frames, such as frames of 1,024 samples each. The information received in the audio bitstream 302 could also include both audio information and control data.

The audio bitstream 302 is provided to a bitstream demultiplexer 304, which provides the information in the bitstream 302 to other components of the audio decoder 102. For example, the information received in the audio bitstream 302 could include both audio information and control data, and the bitstream demultiplexer 304 separates the audio information and control data.

The audio information and the control data are received by a noiseless decoder 306. The noiseless decoder 306 decodes the received audio information. For example, Huffman encoding could have been used to noiselessly encode quantized spectral values, and the noiseless decoder 306 could decode the Huffman-encoded spectral values. The noiseless decoder 306 includes any hardware, software, firmware, or combination thereof for decoding audio information.

The decoded audio information is provided to an inverse quantizer 308, and the control data is provided to a scalefactor decoder 310. The inverse quantizer 308 reverses the quantization of the spectral values performed while the audio data was being encoded. For example, the inverse quantizer 308 could produce de-quantized values corresponding to spectral values or spectral error values with mono/stereo encoding. The inverse quantizer 308 includes any hardware, software, firmware, or combination thereof for de-quantizing audio information.

The scalefactor decoder 310 decodes scalefactors that are included in the de-quantized audio information. Scalefactors are used to reduce quantization noise in different scalefactor bands, where one scalefactor for each scalefactor band is transmitted. If the audio samples in a particular scalefactor band are scaled correctly, quantization noise may be completely masked. The scalefactor decoder 310 includes any hardware, software, firmware, or combination thereof for decoding scalefactors.

An energy calculator 312 identifies the frequency-domain energy of a frame of audio information. For example, the energy calculator 312 may use the decoded information from the scalefactor decoder 310 corresponding to a frame of audio information to identify an average energy of the frame. The energy calculator 312 includes any hardware, software, firmware, or combination thereof for identifying the energy of a frame of audio information.

A middle/side decoder 314 decodes the audio information and separates the audio information into multiple channels. For example, two stereo channels may be highly correlated, and the channels may be transmitted as the sum and difference of the two channels. The middle/side decoder 314 decodes the sums and differences to reconstruct the multiple channels. The middle/side decoder 314 includes any hardware, software, firmware, or combination thereof for decoding multiple channels.

The multiple channel data is received by a prediction unit 316. The prediction unit 316 reverses the effects of time-domain prediction performed by the audio encoder that encoded the audio information in the bitstream 302. The time-domain prediction takes advantage of the correlation between sub-sampled spectral components in frames to more effectively encode stationary signals. The prediction unit 316 processes the multiple channel data to output either prediction errors (if prediction was used to encode the audio data) or spectral values (if prediction was not used). The prediction unit 316 includes any hardware, software, firmware, or combination thereof for reversing time-domain prediction.

An intensity coupler 318 receives the output of the prediction unit 316. The intensity coupler 318 reverses intensity stereo coding used by an audio encoder to encode the audio information in the bitstream 302. The intensity coupler 318 includes any hardware, software, firmware, or combination thereof for reversing intensity stereo coding.

A temporal noise shaping ("TNS") filter 320 processes the output of the intensity coupler 318 to reverse temporal noise shaping used by the audio encoder to encode the audio information in the bitstream 302. For example, the TNS filter 320 may reverse time-domain noise shaping performed by the audio encoder. The TNS filter 320 includes any hardware, software, firmware, or combination thereof for reversing temporal noise shaping.

A filterbank 322 receives and processes the output of the TNS filter 320. The filterbank 322 reverses the effects of a filterbank used by the audio encoder to convert time-domain signals into frequency-domain sub-sampled spectral components. The filterbank 322 includes any hardware, software, firmware, or combination thereof for converting frequency-domain sub-sampled spectral components into time-domain signals.

A gain controller 324 receives and processes the output of the filterbank 322. The gain controller 324 adjusts the gain of the time-domain signals output by the filterbank 322. The gain controller 324 then generates an output signal 326, which represents the decoded audio information corresponding to the bitstream 302. The gain controller 324 includes any hardware, software, firmware, or combination thereof for adjusting the gain of a time-domain signal.

As shown in FIG. 3, the audio decoder 102 also includes a buffer 328, a memory 330, and a frame replacement unit 332. The buffer 328 stores frame energies determined by the energy calculator 312 and decoded audio information in the output signal 326. The memory 330 stores encoded frames of audio information that have been previously received by the audio decoder 102. The frame replacement unit 332 uses the frame energies stored in the buffer 328 and the frames stored in the memory 330 to select and insert replacement frames into gaps caused by delayed or lost frames of audio information. Additional details and operations by the frame replacement unit 332 are described below. The buffer 328 and the memory 330 each represents any suitable memory or memories in any suitable arrangement, such as a solid state memory like an MMC or CF card. The frame replacement unit 332 includes any hardware, software, firmware, or combination thereof for selecting and inserting replacement frames.

Although FIG. 3 illustrates another example of an audio decoder 102, various changes may be made to FIG. 3. For example, the functional division of the audio decoder 102 shown in FIG. 3 is for illustration only. Various components in FIG. 3 may be combined or omitted and additional components could be added according to particular needs.

The following represents an example explanation of the operation of the audio decoders 102 shown in FIGS. 2 and 3 when processing MP3-encoded or AAC-encoded audio information. The audio decoders 102 could operate in the same or similar manner when processing audio information encoded using any other encoding scheme. Details given below about the operation of the audio decoders 102 are for illustration only. The audio decoders 102 could operate in other ways without departing from the scope of this disclosure.

Figure 4:
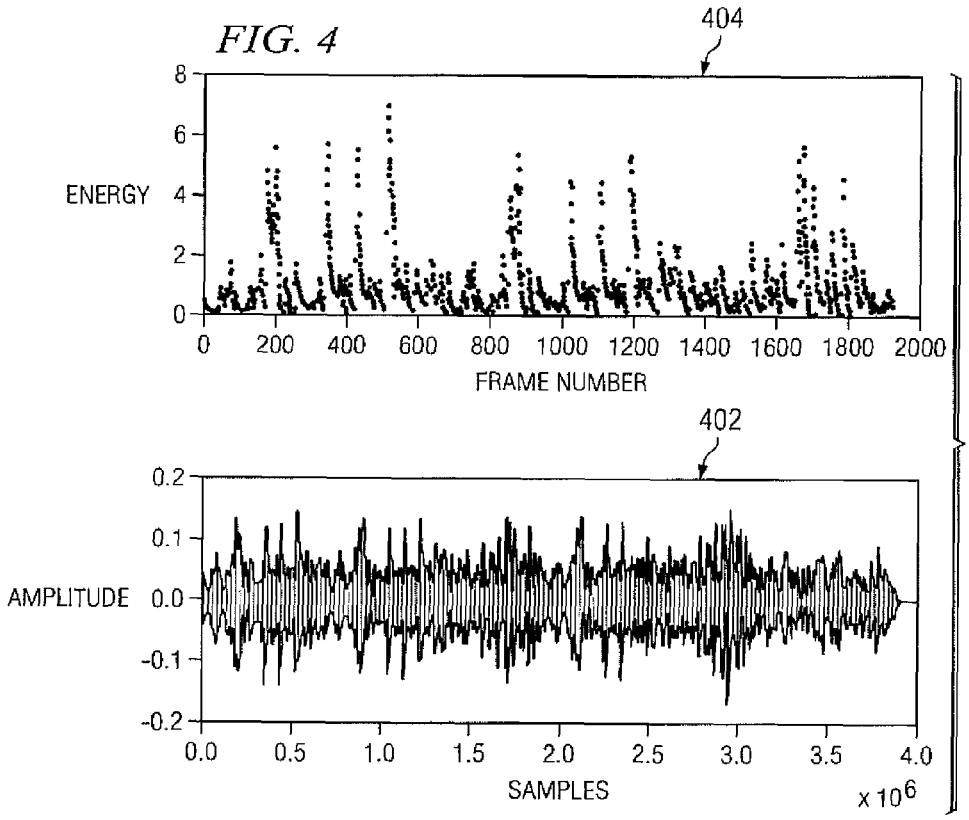
FIG. 4 illustrates an example audio signal according to one embodiment of this disclosure.

Audio signals generally have a rhythm, which is reflected as an energy variation across frames. FIG. 4 illustrates the energy variation of a particular piano composition ("Waltz Number 15" by Brahms). The lower graph illustrates the audio samples 402 representing the piano composition, and the upper graph illustrates the energy 404 for each frame of audio samples. Repetitions in the piano composition lead to repetitions in the energy plot. As the energy of a frame is readily computable, the audio decoder 102 uses an energy-based pattern recognition technique to identify a frame that could be used to replace a missing frame.

The energy calculator 212, 312 in the audio decoder 102 could identify the frame energies 404 using any suitable technique. For example, the energy calculator 212, 312 could compute the energy of the audio frames when each frame is being decoded. In some embodiments, the energy calculator 212, 312 uses the following equation to identify the energy of a frame:

$$E_N = G^2 \sum_{m=1}^{S} \left( scf_m^2 \cdot \sum_{j=1}^{K} \text{spec_coeff}^2[j] \right) \tag{1}$$

where $E_N$ represents the energy of frame N, G represents a global gain in frame N, $scf_m$ represents a scalefactor in subband m, spec_coeff[j] represents the $j^{th}$ decoded spectral value, S represents the maximum number of subbands, and K represents the maximum number of spectral values in the particular subband. Both MP3 and AAC decoders typically have access to all of these parameters. The calculated energies are stored in a buffer 224, 328, and the received encoded frames are stored in a memory 226, 330.

The audio decoder 102 may fail to receive a frame in a sequence of frames. When a missing frame is detected, the frame preceding the missing frame (referred to as the "prior frame") is used as a test frame. The frame replacement unit 228, 332 attempts to identify a previously received frame in the memory 226, 330 that matches or most closely matches the prior frame. The best match is found, and the frame that follows the best match (referred to as a "replacement frame") is identified. The frame replacement unit 228, 332 then uses the identified replacement frame to fill in the gap caused by the missing frame.

The replacement frame (the frame following the best match) is used in place of the missing frame and decoded. While the audio decoder 102 has been described as identifying a replacement frame using frame energies, other or additional techniques could be used to identify a replacement frame for a missing frame. For example, a correlation between a prior frame preceding a missing frame and the frames in the memory 226, 330 could be used to select a replacement frame.

Because the audio information may be received, decoded, and played back in real-time, the audio decoder 102 may use a mechanism to select replacement frames that is computationally efficient. In some embodiments, the audio decoder 102 uses the techniques disclosed in U.S. patent application Ser. Nos. 10/955,904 and 10/955,959, both filed on Sep. 30, 2004 and incorporated by reference herein, to identify a best match to a prior frame that precedes a missing frame. The replacement frame is then selected by identifying the frame that follows the best match.

Figure 5:
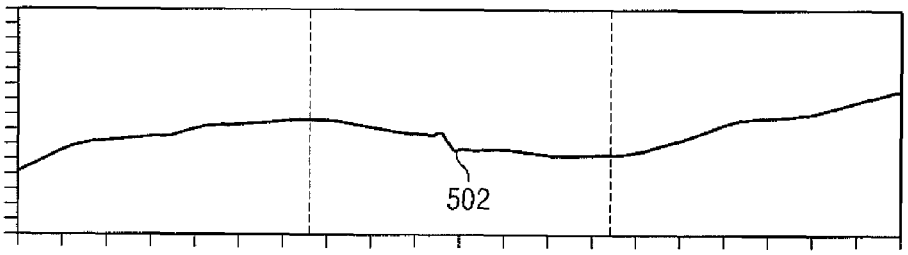
FIG. 5 illustrates an example error in a reconstructed audio signal according to one embodiment of this disclosure.

Once a replacement frame is selected that can fill a gap caused by a missing frame, the replacement frame is spliced into the sequence of frames being received. Splicing allows the replacement frame to be harmoniously inserted into the sequence of frames without creating listening artifacts. As shown in FIG. 5, simply inserting the replacement frame into the sequence of frames could cause a perceptible jump or artifact 502 in the output signal 222, 326.

Figure 6:
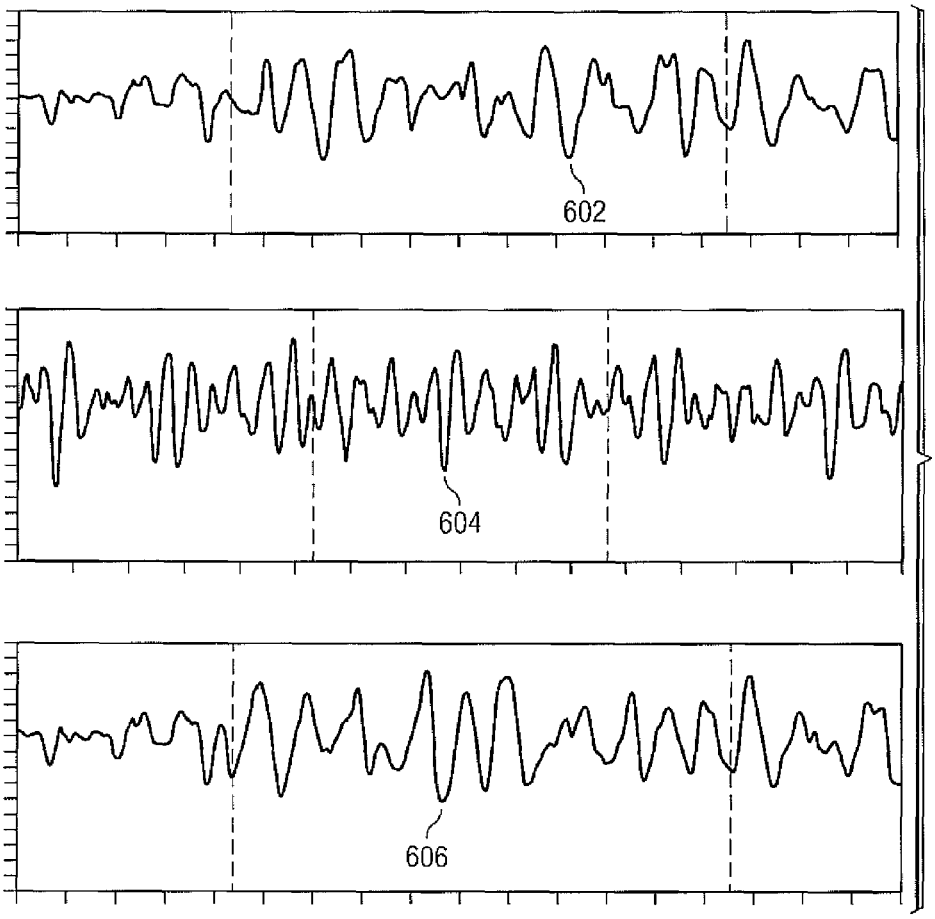
FIG. 6 illustrates an example error reconstruction of audio information according to one embodiment of this disclosure.

As described in more detail below, the frame replacement unit 228, 332 in the audio decoder 102 uses a splicing technique that relies on the amplitude and the phase of the frames being spliced. The splicing technique used by the frame replacement unit 228, 332 helps to ensure a smooth crossover at the boundary of the replacement frame. FIG. 6 illustrates an original sequence of frames 602 containing audio information, where the middle frame (with a white background) represents a frame that is lost during transmission. The frame replacement unit 228, 332 searches for a previously received frame in the memory 226, 330 that most closely matches the frame preceding the missing frame. In this example, the audio decoder 102 determines that a frame (highlighted in black on the left) in a sequence of received frames 604 is the best match. The frame replacement unit 228, 332 selects the frame following the best match in the sequence of received frames 604 as the replacement frame. The frame replacement unit 228, 332 then splices the replacement frame into the original sequence of frames 602 to produce a reconstructed sequence of frames 606. In particular, the replacement frame is spliced with the frame preceding the replacement frame and the frame following the replacement frame. As shown in FIG. 6, the reconstructed sequence of frames 606 does not have any large jumps or artifacts at the boundaries of the replacement frame.

Figure 7:
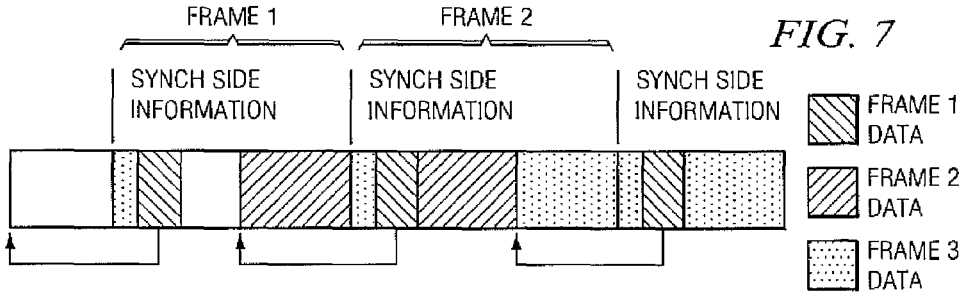
FIG. 7 illustrates an example audio information format according to one embodiment of this disclosure.

Before the replacement frame is spliced into the sequence of frames 602, the replacement frame is retrieved from the memory 226, 330. An example of MP3-encoded frames is shown in FIG. 7. In this example, each frame contains a synchronization ("synch") section that maintains synchronization at the audio decoder 102. The synchronization section also contains an identification of a frame number. To retrieve a particular frame, the frame replacement unit 228, 332 examines the synchronization sections to identify the desired frame and then retrieves the frame's data. If the audio information is encoded using the AAC encoding scheme, the frames include Audio Data Transport Stream ("ADTS") and Audio Data Interchange Format ("ADIF") headers that contain synchronization information. To help speed up retrieval of frames from the memory 226, 330, the offsets of the synchronization information may be stored in the buffer 224, 328 or in the memory 226, 330.

During the splicing of the replacement frame with the other frames in the sequence of frames 602, the number of samples in the frames may decrease. While the lesser number of samples may lead to a small change in pitch, the change may not be noticeable to listeners.

While this process helps to increase the quality of the playback of audio information, the technique used by the frame replacement unit 228, 332 requires larger amounts of memory (such as memory to store measured frame energies and previously received frames). For example, assume a t minute audio signal having a sampling rate $f_s$ is being received. The memory needed to store the frame energies is $$\frac{(t*60)}{N/f_s}$$

where N represents the output frame length. This corresponds to 6,891 values for a three minute MP3-encoded audio signal and 7,752 values for a three minute AAC-encoded audio signal, where the signal is sampled at 44.1 kHz. Because the audio signals may have a repetitive nature due to rhythm and other factors, the amount of memory could be reduced by only storing the frame energies for periodic segments of the audio signal.

While this has described the replacement of a single frame missing in a sequence of frames, the same technique could be used to replace multiple consecutive frames in a sequence of frames. For example, the technique described above could be used to identify a first replacement frame for the first missing frame. The technique may then be repeated using the first replacement frame as the test frame and identifying a second replacement frame. This process may continue until replacement frames for all missing frames have been identified.

In FIGS. 2 and 3, each of the components in the audio decoder 102 could be implemented using any hardware, software, firmware, or combination thereof for performing the identified functions. In this document, the term "logic" may refer to any hardware, software, firmware, or combination thereof for performing a particular function or combination of functions. As an example, logic could include a processor executing software instructions, an application-specific integrated circuit ("ASIC"), a field programmable gate array ("FPGA"), or any other hardware, software, firmware, or combination thereof.

Figure 8:
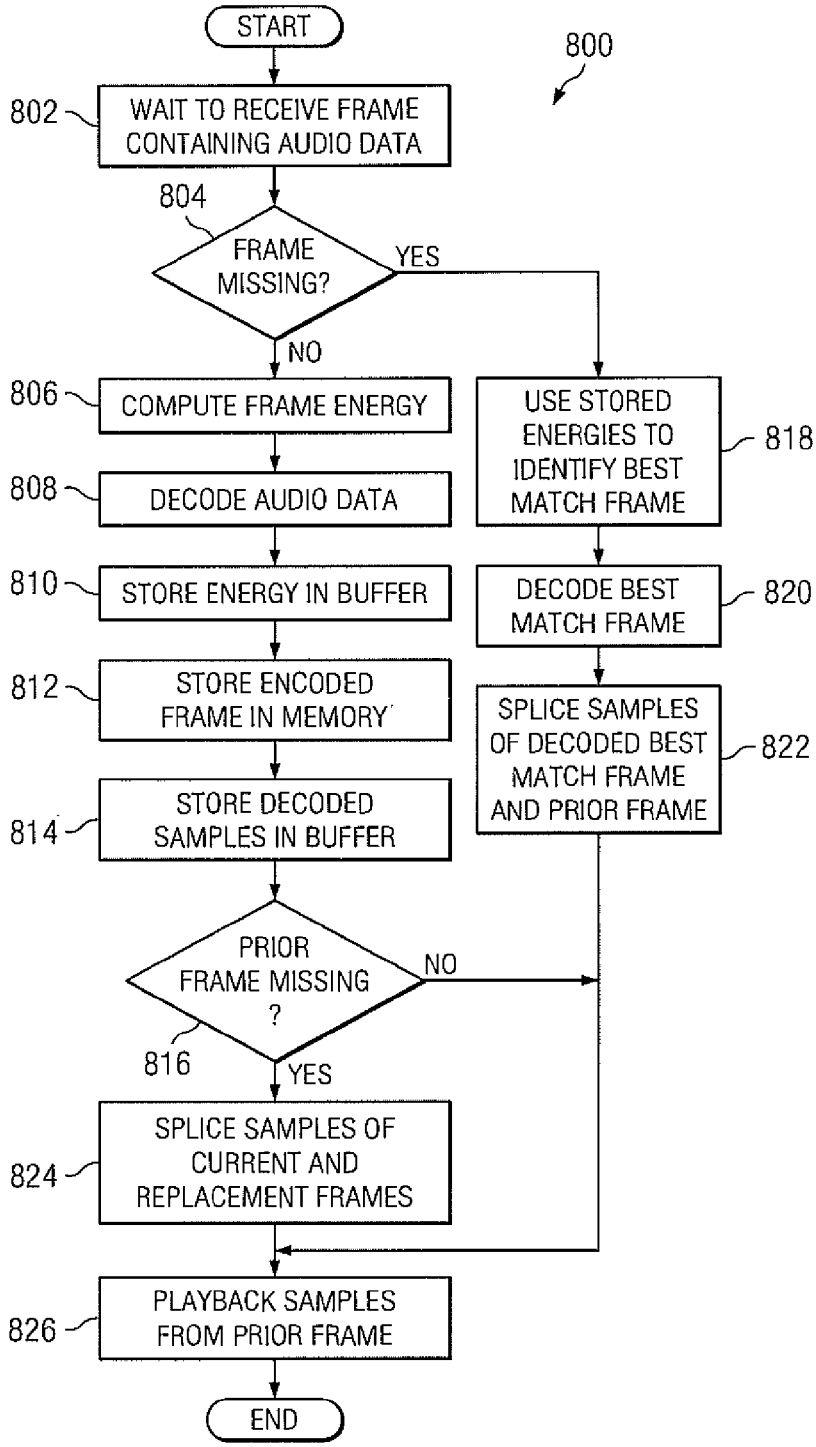
FIG. 8 illustrates an example method for error reconstruction of streaming audio information according to one embodiment of this disclosure.

FIG. 8 illustrates an example method 800 for error reconstruction of streaming audio information according to one embodiment of this disclosure. For ease of explanation, the method 800 is described as being performed by the audio decoder 102 of FIG. 2 or FIG. 3 operating in the system 100 of FIG. 1. The method 800 could be used by any other device and in any other system.

The audio decoder 102 waits to receive a frame of audio information at step 802. This may include, for example, the audio decoder 102 waiting a specified amount of time after a bitstream 202, 302 has begun. The specified amount of time could represent any suitable amount of time.

The audio decoder 102 determines whether a frame is missing at step 804. This may include, for example, the audio decoder 102 determining whether a frame has been received in the specified amount of time.

If a frame has been received, that frame (referred to as the "current frame") is processed. The audio decoder 102 determines an energy for the current frame at step 806. This may include, for example, the Huffman decoder 206, dequantizer 208, and spectrum reorder unit 210 processing the current frame. This may also include the noiseless decoder 306, inverse quantizer 308, and scalefactor decoder 310 processing the current frame. The information from the processed frame is then provided to the energy calculator 212, 312, which may use Equation (1) above or other mechanism to identify the frame energy of the frame.

The audio decoder 102 continues decoding the current frame at step 808. This may include, for example, the joint stereo processor 214, alias reducer 216, IMDCT unit 218, and polyphase filterbank synthesizer 220 processing the current frame. This may also include the prediction unit 316, intensity coupler 318, TNS filter 320, filterbank 322, and gain controller 324 processing the current frame.

The measured frame energy is stored in a buffer at step 810. This may include, for example, the energy calculator 212, 312 storing the frame energy in a buffer 224, 328. The encoded frame is also stored in a memory at step 812. This may include, for example, the bitstream unpacker 204, bitstream demultiplexer 304, or other component in the audio decoder 102 storing an encoded frame in the memory 226, 330. The decoded samples from the current frame are stored in a buffer at step 814. This may include, for example, the polyphase filterbank synthesizer 220 or the gain controller 324 storing the decoded samples in the buffer 224, 328.

Figure 9A:
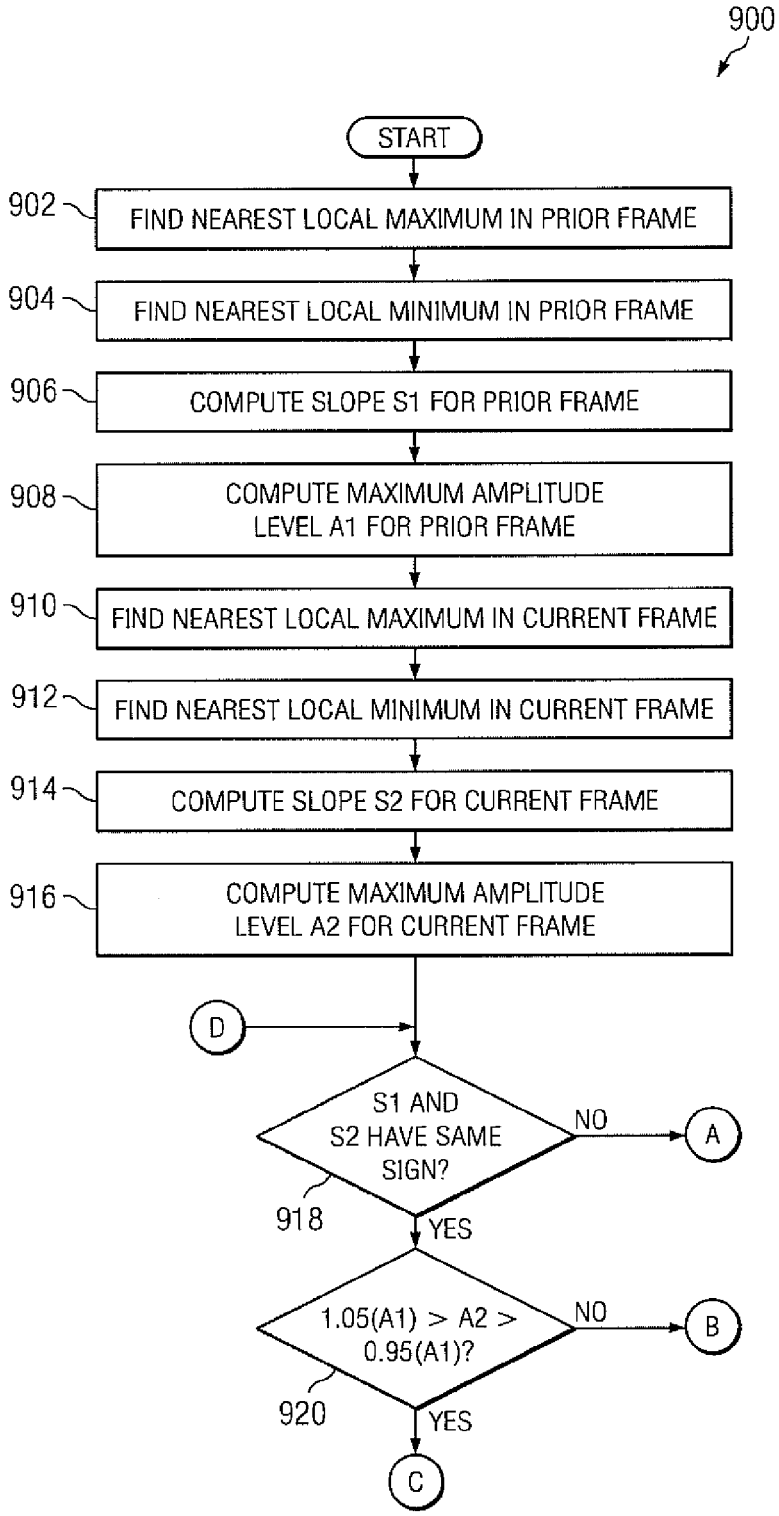
FIGS. 9A and 9B illustrate an example method for splicing audio frames according to one embodiment of this disclosure.
Figure 9B:
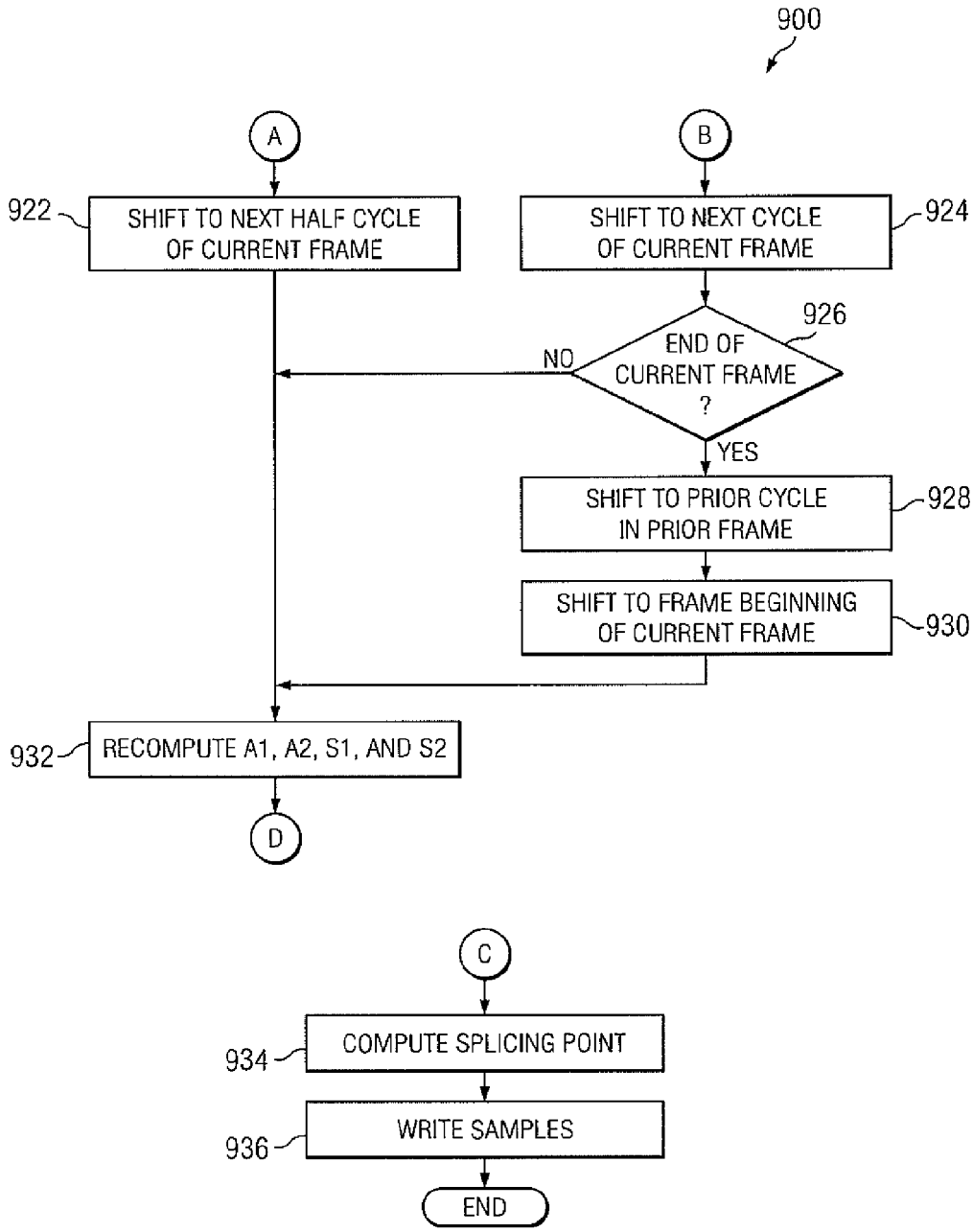

At this point, the audio decoder 102 determines if the prior frame preceding the current frame was missing at step 816. If the frame preceding the current frame was missing, a replacement frame was previously selected and used in place of the missing frame. The samples from the current frame and the samples from the replacement frame are spliced at step 824. A method for splicing samples from neighboring frames is shown in FIGS. 9A and 9B, which are described below.

If the prior frame was not missing at step 816 or the frames have been spliced at step 824, the audio decoder 102 plays the samples from the prior frame at step 826. This may include, for example, the audio decoder 102 retrieving the decoded samples from the buffer 224, 328 and providing the samples to the speaker system 104.

If no frame was received at step 804 (the current frame is missing), the audio decoder 102 uses the frame energy for the prior frame preceding the missing frame to identify a previously received frame that most closely matches the prior frame at step 816. This may include, for example, the frame replacement unit 228, 332 using the frame energy for the prior frame to identify a best matching frame in the memory 226, 330. A replacement frame is selected by identifying the frame that follows the best match.

The selected replacement frame is decoded at step 818. This may include, for example, the frame replacement unit 228, 332 providing the selected replacement frame to the various components for decoding of the audio samples in the replacement frame.

The decoded samples in the replacement frame are spliced with the samples of the prior frame at step 820. This may include, for example, the frame replacement unit 228, 332 using the method shown in FIG. 9, which is described below. The prior frame is then played back at step 826.

Although FIG. 8 illustrates one example of a method 800 for error reconstruction of streaming audio information, various changes may be made to FIG. 8. For example, various steps shown in FIG. 8 may be performed in parallel. As a particular example, the frame energy could be computed and stored in parallel with the decoding and storage of the frames.

FIGS. 9A and 9B illustrate an example method 900 for splicing audio frames according to one embodiment of this disclosure. For ease of explanation, the method 900 is described as being performed by the audio decoder 102 of FIG. 2 or FIG. 3 operating in the system 100 of FIG. 1. The method 900 could be used by any other device and in any other system.

In this example, the method 900 is used by the frame replacement unit 228, 332 to splice audio samples of a current frame with audio samples of a prior frame. The current frame could represent a replacement frame that replaces a missing frame, and the prior frame could represent a frame that precedes the replacement frame. The prior frame could also represent the replacement frame, and the current frame could represent a frame following the replacement frame. In other words, the frame replacement unit 228, 332 uses the method 900 to splice the replacement frame with both the preceding frame and the following frame. By splicing the replacement frame with both the preceding and following frames, the audio decoder 102 may help to reduce or eliminate noticeable glitches at the boundaries of the replacement frame.

The audio decoder 102 locates a local maximum value in the prior frame that is closest to the boundary of the prior and current frames at step 902. This may include, for example, the frame replacement unit 228, 332 identifying the largest audio sample in the last quarter of samples in the prior frame. The local maximum value in the prior frame may be denoted $A_{max1}$. The number of the audio sample in the prior frame that corresponds to the local maximum value may be denoted $n_{max1}$.

The audio decoder 102 locates a local minimum value in the prior frame that is closest to the boundary of the prior and current frames at step 904. This may include, for example, the frame replacement unit 228, 332 identifying the smallest audio sample in the last quarter of samples in the prior frame. The local minimum value in the prior frame may be denoted $A_{min1}$. The number of the audio sample in the prior frame that corresponds to the local minimum value may be denoted $n_{min1}$.

The audio decoder 102 computes a slope $S_1$ for the prior frame at step 906. This may include, for example, the frame replacement unit 228, 332 determining the slope $S_1$ for the prior frame using the following equation:

$$S_1 = \frac{A_{max1} - A_{min1}}{n_{max1} - n_{min1}}. \tag{2}$$

The audio decoder 102 computes a maximum amplitude level $A_1$ for the prior frame at step 908. This may include, for example, the frame replacement unit 228, 332 determining the maximum amplitude level $A_1$ for the prior frame using the following equation:

$$A_1 = \max\{|A_{max1}|, |A_{min1}|\}. \tag{3}$$

The audio decoder 102 then repeats this process for the current frame. The audio decoder 102 locates a local maximum value in the current frame that is closest to the boundary of the prior and current frames at step 910. This may include, for example, the frame replacement unit 228, 332 identifying the largest audio sample in the first quarter of samples in the current frame. The local maximum value in the current frame may be denoted $A_{max2}$, and the number of the audio sample in the current frame that corresponds to the local maximum value may be denoted $n_{max2}$.

The audio decoder 102 locates a local minimum value in the current frame that is closest to the boundary of the prior and current frames at step 912. This may include, for example, the frame replacement unit 228, 332 identifying the smallest audio sample in the first quarter of samples in the current frame. The local minimum value in the current frame may be denoted $A_{min2}$, and the number of the audio sample in the frame that corresponds to the local minimum value may be denoted $n_{min2}$.

The audio decoder 102 computes a slope $S_2$ for the current frame at step 914. This may include, for example, the frame replacement unit 228, 332 using Equation (2) above (with the appropriate values) to identify the slope $S_2$ for the current frame. The audio decoder 102 computes a maximum amplitude level $A_2$ for the current frame at step 916. This may include, for example, the frame replacement unit 228, 332 determining the maximum amplitude level $A_2$ for the current frame using Equation (3) (with the appropriate values).

At this point, the audio decoder 102 uses the slopes $S_1$ and $S_2$ and the maximum amplitude levels $A_1$ and $A_2$ to splice the samples from the prior and current frames. The amplitudes and slopes are used because mismatches between these parameters in the current and prior frames may lead to noticeable glitches or artifacts in the reconstructed audio signal. The audio decoder 102 uses the calculated values for these parameters to splice the frames together in a way that helps to ensure a smooth cross-over at the boundary of the prior and current frames.

In order to splice the frames, the audio decoder 102 determines if the slopes $S_1$ and $S_2$ of the frames have the same sign at step 918. This may include, for example, the frame replacement unit 228, 332 determining if the values of $S_1$ and $S_2$ are both positive or both negative. A common sign may indicate that the portions of the two frames (the last quarter of the prior frame and the first quarter of the current frame) have a common phase.

If the slopes $S_1$ and $S_2$ have a common sign, the audio decoder 102 determines if the maximum amplitude level $A_2$ of the current frame falls within a window around the maximum amplitude level $A_1$ of the prior frame at step 920. This may include, for example, the frame replacement unit 228, 332 determining if the maximum amplitude level $A_2$ falls within a range between $0.95(A_1)$ and $1.05(A_1)$. If this condition is met, it may indicate that the portions of the two frames (the last quarter of the prior frame and the first quarter of the current frame) have amplitudes suitable for splicing. The window allows the audio decoder 102 to determine when the maximum amplitude levels are equal or approximately equal.

If the maximum amplitude level $A_2$ falls within the window around the maximum amplitude level $A_1$, the audio decoder 102 computes a splicing point at which the prior and current frames may be spliced at step 934. For example, the frame replacement unit 228, 332 may determine that the splicing point is at either the maximum positive amplitude or the maximum negative amplitude of the frames. The splicing point may be selected so that the difference in amplitude between the prior and current frames is minimized. In particular embodiments, the frame replacement unit 228, 332 could operate according to the following pseudocode to compute the splicing point:

IF $((A_1>0)$ && $(A_2>0))$
Splice at sample with maximum positive amplitude with minimum amplitude difference
ELSE IF $((A_1>0)$ && $(A_2<0)$ OR $(A_1<0)$ && $(A_2>0))$
Splice at sample from $\max\{|A_{max1}|,|A_{max2}|\}$ with minimum amplitude difference
ELSE IF $((A_1<0)$ && $(A_2<0))$
Splice at sample with maximum negative amplitude with minimum amplitude difference.

Once the splicing point is determined, the audio decoder 102 writes the spliced samples at step 936. This may include, for example, the frame replacement unit 228, 332 writing the spliced samples to a buffer 224, 328. The written samples may then be retrieved and presented to a listener.

If the computed slopes $S_1$ and $S_2$ have different signs at step 918, the audio decoder 102 shifts to the next half cycle of the current frame at step 922. In this example, a "cycle" represents the period between two consecutive local maximums, and a half cycle represents half of this period. By shifting to the next half cycle of the current frame, the audio decoder 102 attempts to splice the prior frame with the current frame at a point that is within the next half cycle of the current frame. In effect, this causes the audio decoder 102 to ignore the samples in the first half cycle of the current frame. At this point, the audio decoder 102 recomputes the slope and amplitude values $S_1$, $S_2$, $A_1$, and $A_2$ at step 932. The audio decoder 102 then returns to step 918 to determine if the frames can be spliced together.

If the slope values have the same sign at step 918 but the value of $A_2$ lies outside of the window around $A_1$ at step 920, the audio decoder 102 shifts to the next cycle in the current frame at step 924. This may include, for example, the audio decoder 102 ignoring the samples in the first cycle of the current frame. The audio decoder 102 then determines if the end of the current frame has been reached at step 926. If not, the audio decoder 102 recomputes the slope and amplitude values $S_1$, $S_2$, $A_1$, and $A_2$ at step 932 and returns to step 918.

If the end of the current frame has been reached, the current frame cannot be spliced with the prior frame using the last cycle of samples in the prior frame. At this point, the audio decoder 102 determines if the frames can be spliced together by ignoring samples in the prior frame. Up until now, the audio decoder 102 has used the last cycle in the prior frame in the analysis of the frames.

The audio decoder 102 shifts to a prior cycle in the prior frame at step 928. This may include, for example, the audio decoder 102 ignoring the samples in the last cycle of the prior frame and using samples in the cycle preceding the last cycle of the prior frame. The audio decoder 102 also shifts back to the beginning of the current frame at step 930. This may include, for example, the audio decoder 102 using the samples in the first cycle of the current frame. The audio decoder 102 then recomputes the slope and amplitude values $S_1$, $S_2$, $A_1$, and $A_2$ at step 932 and returns to step 918. At this point, the audio decoder 102 determines whether the previous cycle in the prior frame and the first cycle in the current frame can be spliced. This process may be repeated until a splicing point in the current and prior frames is located and used to splice the frames.

Although FIGS. 9A and 9B illustrate one example of a method 900 for splicing audio frames, various changes may be made to FIGS. 9A and 9B. For example, FIGS. 9A and 9B illustrate one specific technique that may be used to splice current and prior audio frames. Other techniques for splicing the frames could also be used by the audio decoder 102.

It may be advantageous to set forth definitions of certain words and phrases used in this patent document. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. The term "controller" means any device, system, or part thereof that controls at least one operation. A controller may be implemented in hardware, firmware, or software, or a combination of at least two of the same. It should be noted that the functionality associated with any particular controller may be centralized or distributed, whether locally or remotely.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A method, comprising:

receiving, by an audio decoder, a sequence of frames containing audio information;

identifying, by an energy calculator, a frame energy for each of the sequence of frames based on a number of spectral values related to the audio information;

storing the frame energy for each of the sequence of frames in a buffer;

determining that a frame is missing in the sequence of frames;

comparing the frame that precedes the missing frame to the received frames to identify a selected frame with a frame energy that best matches the identified frame energy for the frame that precedes the missing frame;

identifying the frame that immediately follows the selected frame as a replacement frame;

calculating a splicing point to insert the replacement frame; and inserting the replacement frame into the sequence of frames in place of the missing frame.

2. The method of claim 1, wherein comparing the frame that precedes the missing frame to the received frames comprises comparing the frame energy for the frame that precedes the missing frame to the frame energies of the received frames.

3. The method of claim 2, wherein the selected frame has a frame energy that best matches the frame energy of the frame that precedes the missing frame.

4. The method of claim 1, wherein the frames contain encoded audio information; and further comprising decoding the audio information contained in the received frames and the replacement frame.

5. The method of claim 4, further comprising storing the frames containing encoded audio information in a memory; and wherein inserting the replacement frame into the sequence of frames comprises retrieving the replacement frame from the memory.

6. The method of claim 1, wherein inserting the replacement frame into the sequence of frames comprises splicing the replacement frame with the frame that precedes the missing frame and the frame that follows the missing frame.

7. The method of claim 6, wherein calculating the splice point comprises:

identifying a slope and a maximum amplitude for each of at least a portion of the replacement frame and the frame that precedes the missing frame; and wherein splicing the frames comprises splicing the replacement frame and the frame that precedes the missing frame using the identified slopes and maximum amplitudes.

8. The method of claim 1, wherein calculating the splice point using the identified slopes and maximum amplitudes comprises:

identifying a splicing point in the replacement frame and a splicing point in the frame that precedes the missing frame, wherein the splicing points are identified such that the slopes have a common sign and the maximum amplitudes are at least approximately equal; and splicing the frame comprises splicing the frames at the identified splicing points.

9. The method of claim 1, further comprising:

determining that a frame following the replacement frame is missing;

comparing the replacement frame to the received frames to identify a second selected frame;

identifying a second replacement frame comprising the frame that follows the second selected frame; and inserting the second replacement frame into the sequence of frames after the replacement frame.

10. The method of claim 1, wherein the audio information comprises audio samples encoded using one of: Moving Picture Experts Group Layer III ("MP3") encoding and Moving Picture Experts Group Advanced Audio Coding ("AAC") encoding.

11. The method of claim 1, wherein identifying a frame energy for each of the received frames using a formula of:

$$E_N = G^2 \sum_{m=1}^{S} \left( scf_m^2 \cdot \sum_{j=1}^{K} \text{spec_coeff}^2[j] \right)$$

where $E_N$ represents the frame energy of one of the frames, G represents a global gain of the frame, $scf_m$ represents a scalefactor in an $m^{th}$ subband of the frame, spec_coeff[j] represents a $j^{th}$ spectral value in the $m^{th}$ subband, S represents a maximum number of subbands in the frame, and K represents a maximum number of spectral values in the $m^{th}$ subband.

12. An audio decoder, comprising:

at least one processor including:

decoding logic configured to receive and decode audio information contained in a sequence of frames; and frame replacement logic configured to:

determine that a frame is missing in the sequence of frames;

compare the frame that precedes the missing frame to the received frames to identify a selected frame, based on a frame energy for each frame in the sequence of frames stored in a buffer, the frame energy calculated using a number of spectral values related to the audio information; wherein the selected from comprises a frame energy that best matches the stored frame energy for the frame the precedes the missing frame;

identify the frame that immediately follows the selected frame as a replacement frame;

calculate, based on a slope, a splice point to insert the replacement frame; and insert the replacement frame into the sequence of frames in place of the missing frame.

13. The audio decoder of claim 12, further comprising an energy calculator configured to identify the frame energy for each of the received frames.

14. The audio decoder of claim 13, wherein the decoding logic comprises a Huffman decoder, a dequantizer, a spectrum reorder unit, a joint stereo processor, an alias reducer, an Inverse Modified Discrete Cosine Transform ("IMDCT") unit, and a polyphase filterbank synthesizer.

15. The audio decoder of claim 13, wherein the decoding logic comprises a noiseless decoder, an inverse quantizer, a scalefactor decoder, a middle/side decoder, a prediction unit, an intensity coupler, a temporal noise shaping filter, a filterbank, and a gain controller.

16. The audio decoder of claim 13, further comprising:

a buffer configured to store the frame energies; and a memory configured to store the frames containing encoded audio information.

17. The audio decoder of claim 12, wherein the frame replacement logic is configured to insert the replacement frame into the sequence of frames by splicing the replacement frame with the frame that precedes the missing frame and the frame that follows the missing frame.

18. The audio decoder of claim 17, wherein the frame replacement logic is configured to:

calculate the splice point by identifying a slope and a maximum amplitude for each of at least a portion of the replacement frame and the frame that precedes the missing frame; and splice the frames by splicing the replacement frame and the frame that precedes the missing frame using the identified slopes and maximum amplitudes.

19. The audio decoder of claim 18, wherein the frame replacement logic is configured to calculate the splice joint using the identified slopes and maximum amplitudes by:

identifying a splicing point in the replacement frame and a splicing point in the frame that precedes the missing frame, wherein the splicing points are identified such that the slopes have a common sign and the maximum amplitudes are at least approximately equal; and splicing the frames by splicing the frames at the identified splicing points.

20. The audio decoder of claim 12, wherein the frame energy is defined by a formula of:

$$E_N = G^2 \sum_{m=1}^{S} \left( scf_m^2 \cdot \sum_{j=1}^{K} \text{spec_coeff}^2[j] \right)$$

where $E_N$ represents the frame energy of one of the frames, G represents a global gain of the frame, $scf_m$ represents a scalefactor in an $m^{th}$ subband of the frame, spec_coeff[j] represents a $j^{th}$ spectral value in the $m^{th}$ subband, S represents a maximum number of subbands in the frame, and K represents a maximum number of spectral values in the $m^{th}$ subband.

21. An audio decoder, comprising:

one or more processors collectively configured to:

receive a sequence of frames containing encoded audio information;

determine that a frame is missing in the sequence of frames;

identify a frame energy for each of the received frames calculated using a number of spectral values related to the audio information and storing the frame energy for each frame in the sequence of frames stored in a buffer;

compare the frame that precedes the missing frame to the received frames to identify a selected frame;

identify the frame that immediately follows the selected frame as a replacement frame;

insert the replacement frame into the sequence of frames in place of the missing frame; and decode the audio information contained in the sequence of frames; and at least one memory configured to store the frames containing the encoded audio information.

22. The audio decoded of claim 21, wherein the one or more processors are further collectively capable of comparing the frame that precedes the missing frame to the received frames by comparing the frame energy for the frame that precedes the missing frame to the frame energies of the received frames using a formula of:

$$E_N = G^2 \sum_{m=1}^{S} \left( scf_m^2 \cdot \sum_{j=1}^{K} \text{spec_coeff}^2[j] \right)$$

where $E_N$ represents the frame energy of one of the frames, G represents a global gain of the frame, $scf_m$ represents a scale-factor in an $m^{th}$ subband of the frame, spec_coeff represents a $j^{th}$ spectral value in the $m^{th}$ subband, S represents a maximum number of subbands in the frame, and K represents a maximum number of spectral values in the $m^{th}$ subband.

23. A non-transitory computer readable medium comprising a computer program configured to be executed by a processor, the computer program comprising computer readable program code for:

receiving a sequence of frames containing audio information;

determining that a frame is missing in the sequence of frames;

identifying a frame energy for each of the received frames calculated using a number of spectral values related to the audio information and storing the frame energy for each frame in the sequence of frames stored in a buffer;

comparing the frame that precedes the missing frame to the received frames to identify a selected frame, wherein the selected frame comprises a frame energy that best matches the stored frame energy for the frame the precedes the missing frame;

identifying the frame that immediately follows the selected frame as a replacement frame as a replacement frame;

calculating a splice point to insert the replacement frame; and inserting the replacement frame into the sequence of frames in place of the missing frame.

24. The transitory computer readable medium of claim 23, wherein the computer program further comprises computer readable program code for identifying a frame energy for each of the received frames using a formula of:

$$E_N = G^2 \sum_{m=1}^{S} \left( scf_m^2 \cdot \sum_{j=1}^{K} \text{spec_coeff}^2[j] \right)$$

where $E_N$ represents the frame energy of one of the frames, G represents a global gain of the frame, $scf_m$ represents a scale-factor in an $m^{th}$ subband of the frame, spec_coeff represents a $j^{th}$ spectral value in the $m^{th}$ subband, S represents a maximum number of subbands in the frame and K represents a maximum number of spectral values in the $m^{th}$ subband; and wherein the computer readable program code for comparing the frame that precedes the missing frame to the received frames comprises computer readable program code for comparing the frame energy for the frame that precedes the missing frame to the frame energies of the received frames.

25. The non-transitory computer readable medium of claim 23, wherein the frames contain encoded audio information; and the computer program further comprising computer readable program code for decoding the audio information contained in the received frames and the replacement frame.

26. The non-transitory computer readable medium of claim 23, wherein the computer readable program code for inserting the replacement frame into the sequence of frames comprises non-transitory computer readable program code for splicing the replacement frame with the frame that precedes the missing frame and the frame that follows the missing frame.

27. The non-transitory computer readable medium of claim 26, wherein the computer readable program code for calculating the splice point comprises non-transitory computer readable program code for identifying a slope and a maximum amplitude for each of at least a portion of the replacement frame and the frame that precedes the missing frame; and the computer readable program code for splicing the frames comprises non-transitory computer readable code for splicing the replacement frame and the frame that precedes the missing frame using the identified slopes and maximum amplitudes.

28. The non-transitory computer readable medium of claim 27, wherein the computer readable program code for calculating the splice point using the identified slopes and maximum amplitudes comprises non-transitory computer readable program code for identifying a splicing point in the replacement frame and a splicing point in the frame that precedes the missing frame, wherein the splicing points are identified such that the slopes have a common sign and the maximum amplitudes are at least approximately equal; and the computer readable program code for splicing the frames comprises computer non-transitory readable code for splicing the frames at the identified splicing points.

29. An apparatus, comprising:

an interface configured to receive a sequence of frames of encoded audio information; and an audio decoder configured to:

determine that a frame is missing in the sequence of frames;

compare the frame that precedes the missing frame to the received frames to identify a selected frame;

identify the frame that immediately follows the selected frame as a replacement frame;

calculate a splice point to insert the replacement frame;

insert the replacement frame into the sequence of frames in place of the missing frame;

decode the encoded information in the sequence of frames; and an energy calculator configured to identify a frame energy for each of the received frames calculated using a number of spectral values related to the audio information and storing the frame energy for each frame in the sequence of frames stored in a buffer.

30. The apparatus of claim 29, wherein the audio decoder is configured to compare the frame that precedes the missing frame to the received frames by comparing the frame energy for the frame that precedes the missing frame to the frame energies of the received frames and wherein the energy is calculated using a formula of:

$$E_N = G^2 \sum_{m=1}^{S} \left( scf_m^2 \cdot \sum_{j=1}^{K} \text{spec_coeff}^2[j] \right)$$

where $E_N$ represents the frame energy of one of the frames, G represents a global gain of the frame, $scf_m$ represents a scale-factor in an $m^{th}$ subband of the frame, spec_coeff represents a $j^{th}$ spectral value in the $m^{th}$ subband, S represents a maximum number of subbands in the frame, and K represents a maximum number of spectral values in the $m^{th}$ subband.

* * * * *